US008826674B2

(12) United States Patent
Usoskin

(10) Patent No.: US 8,826,674 B2
(45) Date of Patent: Sep. 9, 2014

(54) CRYOSTAT FOR AN ELECTRICAL POWER CONDITIONER

(75) Inventor: Alexander Usoskin, Hoesbach (DE)

(73) Assignee: Bruker HTS GmbH, Hanau (DE)

( * ) Notice: Subject to any disclaimer, the term of this patent is extended or adjusted under 35 U.S.C. 154(b) by 1373 days.

(21) Appl. No.: 12/500,386

(22) Filed: Jul. 9, 2009

(65) Prior Publication Data

US 2010/0005813 A1 Jan. 14, 2010

(30) Foreign Application Priority Data

Jul. 10, 2008 (EP) ..... 08012514

(51) Int. Cl.

| | |
|---|---|
| ***F25B 19/00*** | (2006.01) |
| ***H01B 12/00*** | (2006.01) |
| ***H01F 1/00*** | (2006.01) |
| ***H01F 6/00*** | (2006.01) |

(52) U.S. Cl.

CPC ..... *H01F 6/00* (2013.01)
USPC ..... 62/51.1; 174/15.4; 335/216

(58) Field of Classification Search

USPC ..... 62/6, 51.1; 174/15.4; 335/216; 323/360
See application file for complete search history.

(56) References Cited

U.S. PATENT DOCUMENTS

| | | | | |
|---|---|---|---|---|
| 5,107,240 | A | 4/1992 | Tashiro et al. | |
| 5,248,657 | A * | 9/1993 | Bailey et al. | 505/412 |
| 5,847,633 | A | 12/1998 | Keller et al. | |
| 6,157,276 | A | 12/2000 | Hedeen et al. | |
| 6,324,851 | B1 * | 12/2001 | Szasz et al. | 62/51.1 |
| 6,759,593 | B2 * | 7/2004 | Spreafico | 174/125.1 |
| 2004/0216915 | A1 * | 11/2004 | Hirose | 174/125.1 |
| 2004/0265649 | A1 * | 12/2004 | Selvamanickam | 428/701 |
| 2008/0194411 | A1 * | 8/2008 | Folts et al. | 505/110 |
| 2010/0099571 | A1 * | 4/2010 | Usoskin | 505/230 |

FOREIGN PATENT DOCUMENTS

| | | |
|---|---|---|
| EP | 1544873 | 6/2005 |
| WO | WO 94/03955 | 2/1994 |

OTHER PUBLICATIONS

European Search Report dated Nov. 18, 2008 for International Application No. EP08012514.

* cited by examiner

*Primary Examiner* — Frantz Jules
*Assistant Examiner* — Webeshet Mengesha
(74) *Attorney, Agent, or Firm* — Dickinson Wright PLLC

(57) ABSTRACT

A cryostat for electric power conditioner comprising external walls (1, 3, 11) in contact with an ambient medium, internal walls (2, 12, 13) in contact with a cooled medium and a thermal insulating gap (4, 14) formed between the external walls (1, 3, 11) and the internal walls (2, 12, 13). At least one part of the at least one external wall (1, 3, 11) and/or at least one part of the at least one internal wall (2, 12, 13) of the cryostat comprises a layered structure (15, 16, 17).

18 Claims, 6 Drawing Sheets

CRYOSTAT FOR AN ELECTRICAL POWER CONDITIONER

BACKGROUND

1. Field

The invention relates to a cryostat arrangement for an electrical power conditioner, more particularly, to a cryostat for use with superconducting transformers, superconducting fault current limiters, superconducting power devices for phase correction, etc.

2. Description of Related Art

Cryostats for electrical power conditioners are known which may be provided in one of the following two variants: (i) a cryostat comprising no opening for accommodating a ferromagnetic limb, and (ii) a cryostat with one or more openings for accommodating one or more ferromagnetic limbs.

A cryostat for electric power conditioner of type (i) is described for instance in EP 1 544 873 A2. The cryostat comprises external walls in contact with an ambient medium, internal walls in contact with a cooled medium, a thermal insulating gap formed between the external walls and the internal walls, the insulating gap comprising a thermal insulation. The thermal insulation is provided in this technical solution by vacuum; the insulating gap is evacuated.

The external walls comprise one cylindrical wall and two flat walls; a first external wall from the top (in the cap flange) and a second external wall from the bottom. In the same way, the internal walls comprise one cylindrical wall and two flat walls; a first internal wall from the top (in the cap flange) and a second internal wall from the bottom. The cryostat comprises also means for forming a liquid from a gas.

Both the external walls and the internal walls comprise a uniform structure and are made from a homogeneous metallic sheet.

A similar construction of a cryostat for electric power conditioners is disclosed in WO 94 003 955 A1. The cryostat comprises practically the same features as in the EP 1 544 873 A2 with a difference that the cap flange is converted in an upper external wall and an upper internal wall.

A cryostat with a central axial opening is also disclosed in U.S. Pat. No. 5,847,633 A which has similar features to those cryostats discussed above.

A cryostat for electric power conditioner of type (ii), i.e. with an internal opening for a ferromagnetic limb, is disclosed in U.S. Pat. No. 5,107,240 A, for example. The cryostat comprises external walls in contact with an ambient medium, internal walls in contact with a cooled medium and a thermally insulating gap formed between the external walls and the internal walls. The thermally insulating gap comprises a thermal insulation provided by vacuum.

The external walls comprise two cylindrical walls and two flat walls: a first external flat wall forms the top side (in the cap flange) and a second external flat wall forms the bottom side. The internal walls comprise two cylindrical walls and a flat wall forms the bottom side.

The external walls and the internal walls comprise a uniform structure and are formed from a homogeneous glass fiber reinforced vinyl polyester resin (FRP). As mentioned above, a vacuum is created between these FRP walls to provide the thermal insulation.

The ambient medium in this cryostat is provided by a ferromagnetic shell which serves for guiding of a magnetic flux. This material is kept practically at ambient temperature by means of natural or forced heat exchange. The ferromagnetic shell may play also a role of a fixture for the external walls. This fixture may provide an external mechanical stabilization of the cryostat (e.g. in case of electromagnetic forces) and may also allow, nevertheless, forces caused by presence of the vacuum between the external walls and the internal walls to be compensated.

In order to provide such compensation in the cryostat for electric power conditioner disclosed in U.S. Pat. No. 6,324,851 B1 the thermal insulating gap is filled, at least in part with a solid thermal insulator. The cryostat comprises external walls being in contact with an ambient medium, internal walls being in contact with a cooled medium, a thermal insulating gap formed between the external walls and the internal walls, the insulating gap comprising a thermal insulation.

In the arrangement disclosed in U.S. Pat. No. 6,324,851 B1, the thermal insulation is provided partly by the solid thermal insulation and partly by a vacuum.

The external walls comprise a plurality of side walls defining a plurality of openings, each of which can accommodate a ferromagnetic limb and two flat walls. The internal walls comprise also a plurality of side walls and two flat walls. Furthermore, the cryostat comprises means for filling in with a liquidized gas or/and means for gas liquidizing.

The external walls and the internal walls comprise a uniform structure. The external walls are made of metal sheet. The internal walls are made of a fiber composite material comprising properties of an electrical insulator.

The solid thermal insulator plays a role of a spacer and is load bearing. The solid thermal insulator is able to transmit the internal pressure acting on the internal walls to the external walls. The thermal conductivity of the solid thermal insulator (e.g. of 2 mW/(K×m)) is relatively low, but, however, not low enough to be compared to the vacuum insulation.

Comparing different technical solutions of the actual state of the art one may conclude that there is an obvious dilemma: (a) to employ a cryostat with the metallic walls which may provide an excellent and long-lifetime vacuum insulation and needs practically no maintenance, but causes high eddy currents and therefore leads to elevated cooling losses, or (b) to employ a cryostat with insulating walls (i.e. the walls without eddy current losses) which are much less vacuum tight and, as a result, the cryostat has to be periodically pumped in order to maintain a sufficient vacuum. Thus, in the latter case an additional periodic maintenance a special service means are needed while the lifetime of the cryostat is shorter.

Further improvements to the arrangements of cryostats for use in electrical power conditioners which overcome at least some of these disadvantages are desirable.

It is, therefore, desirable to provide an improved cryostat for use in electrical power conditioners avoids at least some of these disadvantages.

SUMMARY

A cryostat for an electrical power conditioner is provided which comprises at least one external wall, at least one internal wall defining a volume to be cooled and a thermally insulating gap formed between the at least one external wall and the at least one internal wall. In operation, the external wall is in contact with an ambient medium and the internal wall is in contact with a cooled medium. According to the invention, at least one part of the at least one external wall and/or at least one part of the at least one internal wall comprises a layered structure.

The layered structure enables the properties of the internal wall and/or external wall and, therefore, the properties of the cryostat, to be better suited for electrical power applications.

For example, a layer of the structure defining the volume to be cooled may be gas impermeable so as to hinder leakage into the thermal insulating gap.

In an embodiment, the layered structure comprises a continuous layer and a discontinuous layer. The continuous layer may be gas impermeable and vacuum-tight and the discontinuous layer may provide one or more discontinuities so as to hinder the formation of induced circular currents in the wall which lead to cooling losses.

In a further embodiment, the layered structure further comprises an insulation layer arranged between the continuous layer and the discontinuous layer. The insulating layer may be electrically as well as thermally insulating.

The layered structure may further comprise a plurality of channels. These channels may extend between a free space positioned between the continuous layer and the discontinuous layer and the thermally insulating gap. In the case that the thermally insulating gap is evacuated, the free space positioned between the continuous and discontinuous layer is also evacuated.

In an embodiment, the continuous layer comprises a surplus in a length in at least one longitudinal direction. For example, the continuous layer may define a general cylinder. A surplus enables the diameter of the cylinder to be flexible to a degree and, due to this, to reduce tensile stress in the continuous layer to a secure level. The continuous layer may comprise a wavy shape or a zigzag shape or a meander shape or any combination of at least two of these shapes in order to provide the surplus. The continuous layer may be flexible. The degree of flexibility may be controlled by a suitable choice of the material of the continuous layer as well as of the thickness of the layer. In one embodiment, the continuous layer comprises a metal, for example a steel.

In an embodiment, the discontinuous layer comprises at least one segment comprising an electrically insulating material. The segment is positioned to hinder the flow of a circular current around said discontinuous layer and, therefore, to reduce the cooling losses. The discontinuous layer may comprise a metal such as a steel.

In further embodiments, the discontinuous layer comprises a mechanical stabilizer mechanically coupled to the continuous layer. This enables a very thin continuous layer to be used which reduces the losses caused by the continuous layer while still providing a wall with the required mechanical stability.

The mechanical stabilizer may comprises an additional electrical insulation arranged to hinder the flow of a circular current around said layered structure. The electrical insulation may be provided in the form of one or more separate regions, such as stripes, arranged in the discontinuous layer and/or continuous layer so as to provide electrical insulation between different parts of the discontinuous layer and/or continuous layer, respectively. The electrical insulation my also be provided in the form of a layer which is, for example arranged between the continuous layer and the discontinuous layer so as to electrically isolate the continuous layer and the discontinuous layer from one another.

The insulation layer may be arranged in contact with, but not bonded to, or may be bonded to the continuous layer and/or to the discontinuous layer.

Disclosed herein, therefore, is a cryostat for electrical power conditioner with reduced cooling losses as well as with reduced power losses in the electrical power conditioner. Furthermore, a cryostat for electrical power conditioner with increased lifetime and reduced maintenance costs is provided.

BRIEF DESCRIPTION OF THE DRAWINGS

Embodiments of the cryostat for an electric power conditioner described herein can be better understood with reference to the following drawings and description. The components in the drawings are not necessarily to scale, but are instead provided to illustrate the principles of the device. Moreover, in the figures, like reference numerals designate corresponding parts. In the drawings.

DETAILED DESCRIPTION OF SPECIFIC EMBODIMENTS

Figure 1:
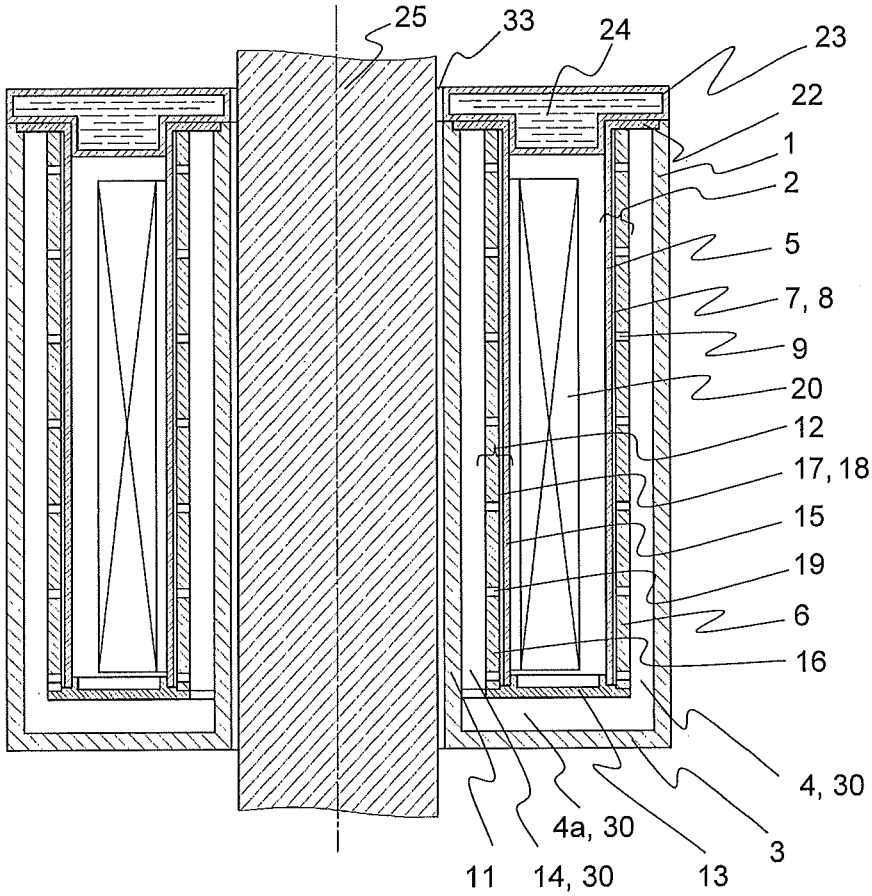
FIG. 1 is a schematic axial cross sectional view of a cryostat for electric power conditioner.
Figure 2:
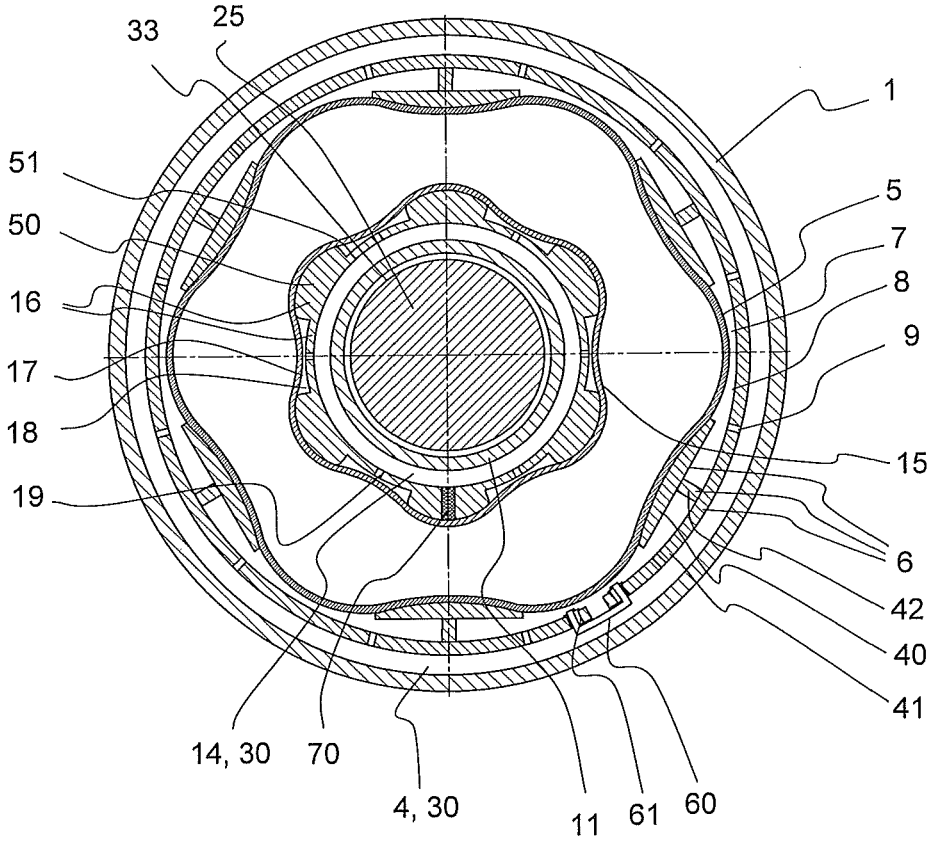
FIG. 2 is a schematic top cross sectional view of a cryostat for electric power conditioner perpendicular to the view shown in FIG. 1.

FIG. 1 is an axial cross sectional view of first embodiment a cryostat for electric power conditioner disclosed herein. A cross-sectional view perpendicular to that of FIG. 1, i.e. a top view, is depicted in FIG. 2 for the embodiment of the cryostat shown in FIG. 1.

The cryostat comprises external walls 1, 3, 11 being in contact with an ambient medium, internal walls 2, 12, 13 in contact with a cooled medium and a thermally insulating gap 4, 14 formed between the external walls and the internal walls, wherein the thermal insulating gap comprising a thermal insulation 30.

Two of the internal walls 2, 12 are generally cylindrical and are arranged concentrically so that the first internal wall 2 has a greater diameter than the second internal wall 12. The internal walls 2, 12 of the cryostat comprise a layered structure which comprises a continuous layer 5, 15, a discontinuous layer 6, 16 and an insulation layer 7, 17 arranged between the continuous layer 5, 15 and the discontinuous layer 6, 16. The continuous layers 5, 15 define the volume to the cooled.

The layered structure of the internal walls 2, 12 further comprises a plurality of channels 9, 19 connecting a free space 8, 18 between the continuous layer 5, 15 and the discontinuous layer 6, 16 with the thermal insulating gap 4, 14.

The continuous layer 5, 15 of the respective internal walls 2, 12 is formed with a surplus in a length in at least one longitudinal direction, in this embodiment, the circumferential direction, and comprise a wavy shape in the top view of FIG. 2.

In further embodiments, the continuous layer 5, 15 may comprise as well a zigzag shape or a meandering shape or any combination of the above mentioned shapes. The continuous layer 5, 15 is vacuum tight, flexible and comprises a metal.

The discontinuous layer 6, 16 of the respective internal wall 2, 12 comprises at least one segment which forms a non-conducting circuit for a circular current which may spread around at least one axis. The discontinuous layer 6, 16 also comprises a metal and further comprises a mechanical stabilizer 41, 42, 51 which is applied to the continuous layer 5, such that the continuous layer 5, 15 of the internal walls 2, 12 can withstand durable mechanical loads despite having a small thickness.

The discontinuous layer 6, 16 may comprise a former 40, 50 which provide at least partial mechanical contact with the continuous layer 5, 15 via the insulation layer 7, 17. The mechanical stabilizer may comprise either an interconnection segment 51 or both the interconnection segment 41 and a plurality of fingers 42 each of which bonds the former 40 with the interconnection segment 41.

The former 40, 50 reduces a radius of curvature of the continuous layer in a way that the radius of curvature is smaller by factor from 1.5 to 100 in a section of the continuous layer which is arranged in between two adjacent formers. This allows the thickness of the continuous layer to be reduced as this thickness is dependent on the allowed tensile stress in this layer, a differential pressure and a radius of curvature in accordance with the following dependence:

$$t=[k\cdot P\cdot R/(2\cdot\sigma)]+g$$

where t (in mm) is the thickness of the continuous layer, k is a experimental coefficient that may vary from 0.8 to 2.5 depending on the art of the cryostat and the required performance (as e.g. lifetime duration), P (in MPa) is a differential pressure acting to the wall (this pressure is practically equal to the pressure of the ambient medium for the external walls and of the cooled medium for the internal walls), R (in mm) is the radius of curvature of the continuous layer between two adjacent formers, σ (in MPa) is a maximal tensile stress that allows the material of the continuous layer, and g=0.002 mm.

The mechanical stabilizer 41, 42, 51 itself comprises an additional electrical insulation 60, 61, 70 that avoids propagation of the circular current which may spread around the at least one axis. In an embodiment, the additional electrical insulation is provided by a single dielectric (ceramic) insertion 70 provided in a slit of the discontinuous layer 16 of the internal wall 12 of smaller diameter and/or by two dielectric insertions 61 which insulate a squeezer 60 from the interconnection segment 40, 41 of the mechanical stabilizer 41, 42 of the internal wall 2 of greater diameter.

Furthermore, in a particular embodiment, the maximal thickness of the discontinuous layer 6, 16 exceeds the thickness of the continuous layer 5, 15 by a ratio factor of 30; nevertheless, depending on the construction, this factor may vary from 2 to 5000. The lower limit of this range is determined by a threshold of mechanical stability of the discontinuous layer 6, 16, while the upper limit is dependent on tolerance for magnetic flux leakage. The latter value is mainly determined by the entire thickness of the cryostat walls including the thickness of the thermal insulation gap 4, 14.

In a particular embodiment, the entire thickness of the inner wall should not exceed 100 mm, even for high power consumption of the power conditioner; therefore in such embodiments the discontinuous layer 6, 16 may be approximately 50 mm thick in maximum. Thus, at acceptable thicknesses of the continuous layer 5, 15, which may be defined by the optimal range from 0.01 to 2 mm, the upper limit of the ratio factor can be 5000. Higher values of the ratio factor can lead to the thickness of the continuous layer being less than 0.01 mm. This thickness is still sufficient to keep gas penetration through the continuous layer at sufficiently low levels, especially at low temperatures such as e.g. 77 K. Calculations yield a lifetime of vacuum insulation of more than 100 years. Nevertheless, homogeneity of such thin foils may not be sufficient to avoid local "perforations" which become the main reason for gas leakage.

The insulation layer 7, 17 is formed in a way that it provides electrical insulation between the continuous layer 5, and the discontinuous layer 6, 16 of the internal walls 2, 12, respectively, as well as between different parts of the continuous layer 5, 15. The insulation layer 7, 17 in the resent embodiment is bonded to the continuous layer 5 and 15. Alternatively, the insulation layer 7, 17 may be bonded only to the discontinuous layer, namely to the former 40, 50, or may be bonded to both the continuous and the discontinuous layers. A layer epoxy resin, 15-25 micrometer thick, is employed in the present embodiment as a specific example of the insulation layer 7 and 17.

The thermal insulation gap 4, 14 can comprise a plurality of screens 30 (not shown explicitly in figures) comprising a high reflectivity in the infrared range of the optical spectrum. Each screen from the plurality of screens comprises a structure which does not conduct electrical current in at least one longitudinal direction. Further, in the present embodiment the thermal insulation gap 4, 14 is evacuated and may comprise a gas absorber (means for gas absorbing).

The cryostat of the present example may comprise a mechanism for filling the working volume with a liquidized gas or/and means for gas liquidizing as well as an additional mechanism for control of pressure of a vaporized gas. In general, the cryostat described above may be used in a fault current limiter, an electrical transformer, or other electrical devices for power conditioning. In particular, the cryostat may be used in superconducting fault current limiters, superconducting transformers, and other electrical devices for power conditioning which include a superconducting component.

In the embodiment of FIG. 1 and FIG. 2, the cryostat comprises an opening 33 for positioning of a ferromagnetic limb 25. The opening 33 is defined by the external wall 11 and is arranged concentrically around the cryostat axis. A space between the internal walls 2, 12 is used for positioning of an electrical coil 20 and filled with cooled medium (liquidized nitrogen in this case).

The embodiments of the cryostat illustrated in the figures each comprise a single opening for accommodating a ferromagnetic limb. However, the multilayer structures of the internal wall and/or external wall may also be used to provide a cryostat having no opening, i.e. a single cylindrical internal wall defines the volume to be cooled, or a cryostat having two or more openings, each for a ferromagnetic limb.

The continuous layer 5, 15 of the layered structure of the internal walls 2, 12 is based on a 0.3 mm thick sheet of Cr—Ni stainless steel. The mean diameters of the continuous layer 15 and the spaces enclosed by the continuous layer 5 are 420 mm and 540 mm, respectively.

The continuous layer 5, 15 is supported by the formers 40, 50 of the discontinuous layers 6, 16 from the side of the thermal insulation gap 4, 14.

In order to avoid closed volumes and thus to achieve an equal differential pressure acting to the continuous layers 5, 15, the insulation layer 7, 17 comprises a periodically varied thickness having a period which equals to the thickness of continuous layers 5, 15 multiplied by a factor from 0.1 to 20. In the embodiment illustrated in FIGS. 1 and 2, this period was from 0.8 to 1.5 mm.

Figure 3:
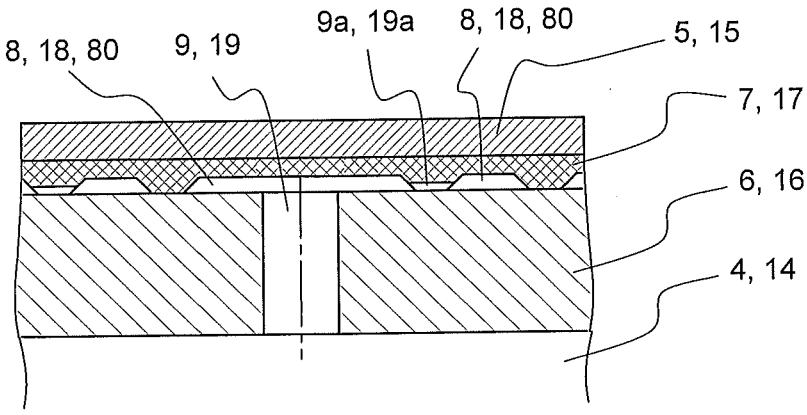
FIG. 3 is a schematic cross sectional view of a layered structure of the first embodiment of the cryostat for electric power conditioner.

As shown in FIG. 3, valleys 80 of such relief representing a portion of the free space 8, 18 between the continuous layer 5, 15 and the discontinuous layer 6, 16 are connected between themselves by a portion of channels 9*a*, 19*a*. They are connected finally through the channels 9, 19 to the thermal insulating gap 4, 14.

The continuous layers 5, 15 and the interconnection segments 41, 51 of the discontinuous layers 6, 16 are welded to a bottom ring 13 and are welded using two interconnection rings 22 to the external walls 1 and 11, respectively. The interconnection rings 22 as well as the bottom ring 13 may also comprise a layered structure similar to internal walls 2, 12. Nevertheless, a simple single wall structure of these rings may also be sufficient regarding low power losses as the 1.5-3 mm thick rings made of stainless steel share a relatively small fraction of total secondary current. In case of the rings 13, 22 with layered structure, additional corrugated insertions are required to provide an interconnection of the internal layers of the internal walls and of the rings. The upper part of the cryostat is closed with ring-cover possessing a thin wall housing which is evacuated and filled with a thermal insulation 24 similarly to the thermal insulation gap 30.

In case of operation of the cryostat within a fault current limiter, the coil inside of the cryostat comprises short circuited windings of a high temperature superconductor (HTS)—a HTS coated conductor in the given case. The HTS coated conductor is provided by an $YBa_2Cu_3O_{7-x}$ coated tape. A magnetic flux that is guided through the ferromagnetic limb 25 causes eddy currents in all cryostat walls as well as in the short circuited coil 20. Desirably, the ferromagnetic limb 25 contains iron.

In this embodiment, the main system losses are determined by cooling losses in the continuous layers 5 and 15. Nevertheless, in the normal (not quenched) state, the highest eddy current is provided in the coil 25 while the continuous layer 5 in considerably screened by the coil and stays under lower current load.

At the nominal current in the primary coil (which is not shown in FIG. 1 and FIG. 2), which equals to 1000 A rms the eddy current which is induced in continuous layer 15 is 61 A rms. This current causes a power dissipation of 4.8 W in the continuous layer 15 of the multi-layered internal wall 12. This dissipated power would rise to 64 W in a cryostat with a single 4 mm thick metallic internal wall made of the same stainless steel as the continuous layer 15.

Thus, the cooling losses are significantly lower as a result of the multi-layer internal wall arrangement described herein. This is advantageous in operation of the entire power conditioner because the cooling efficiency is typically only 3-5% at 77 K. The cryostat described herein results not only in lowering of energy losses by a factor of 13 (in the considered case), but also the lower cooling losses allow the use of more cost efficient cryogenic cryocoolers. This reduces costs for their maintenance by a factor of about 10.

Figure 4:
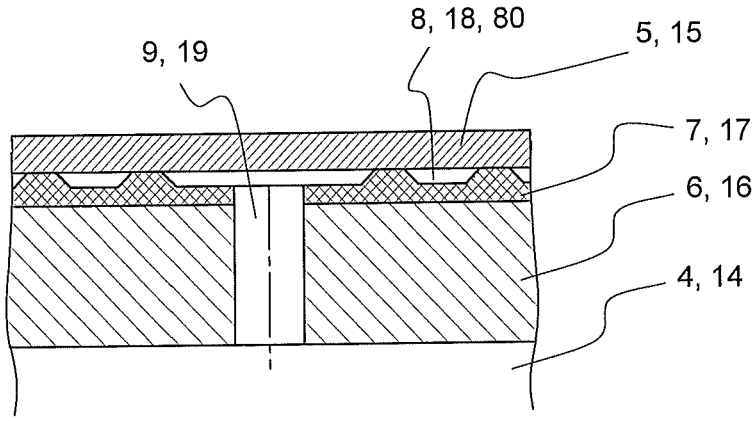
FIG. 4 is a schematic cross sectional view of an alternative variant for the layered structure of the first embodiment of cryostat for electric power conditioner.

FIG. 4 illustrates a further embodiment of the same layered structure as shown in the FIG. 3 with a difference that the insulation layer 7, 17 is bonded to the former 40, 50 instead of to the continuous layer 5, 15.

Figure 5:
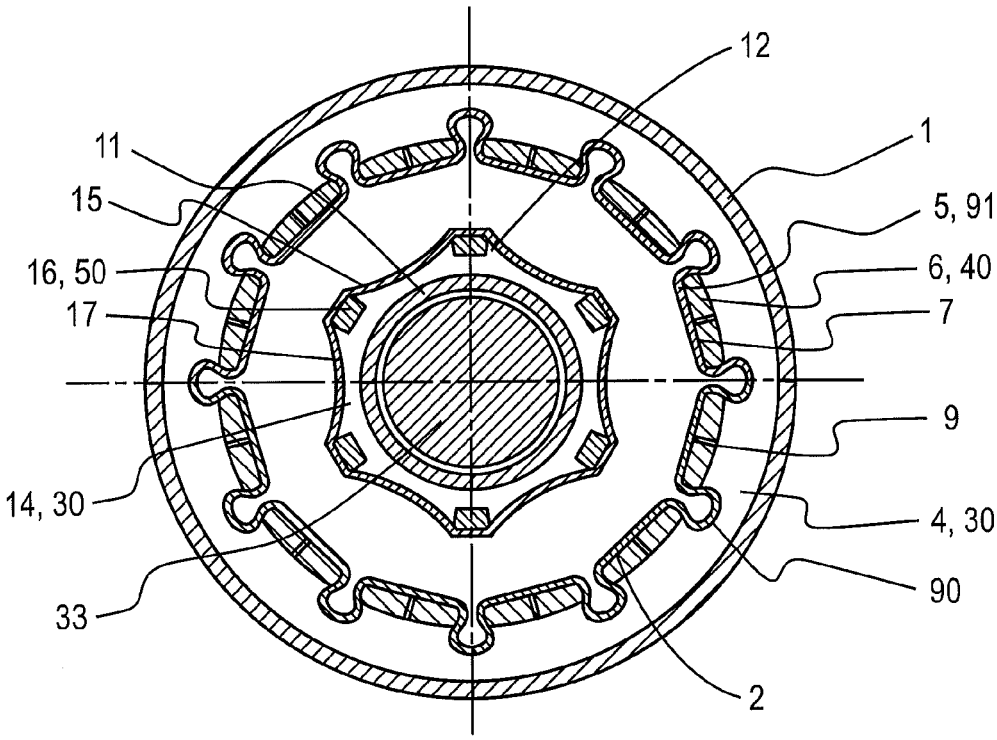
FIG. 5 is a schematic top cross sectional view of a cryostat for electric power conditioner according to a second embodiment.

A further embodiment is depicted in FIG. 5, in which a cryostat with the continuous layer 5 comprising a wavy-meandering shape is supported by formers 40 of the discontinuous layer 6. The main features of this example are similar to the first example of FIG. 1 with the following differences.

The shape of the continuous layer 5 comprises a plurality of elements 90 comprising a higher curvature (with a radius of curvature of 20 mm as illustrated) and a plurality of elements 91 arranged at intervals around a generally circular internal wall 2 and comprising a lower curvature with radius of about 260 mm. These lower curvature elements 91 are arranged between, and thus separate, the higher curvature elements 90.

An insulation layer 7 is bonded to surface of the former 40 in case of continuous layer 5 of internal wall 2. In case of continuous layer 15 of internal wall 12, the insulation layer 17 is bonded to the continuous layer 15 which is insulated from the formers 50 of the discontinuous wall 16 due to the insulation layer 17. For both discontinuous walls 6 and 16 the interconnection segments of the mechanical stabilizer are not shown in FIG. 5.

Due to the described above shape of continuous layer 5, its thickness is further reduced to 0.15 mm. This allows low power and cooling losses of 4-6 W to be provided in the case when the primary coil is wound around the outside wall of the cryostat and thus the eddy currents are more pronounced in the "outer" continuous layer 5 of internal wall 2 than in the continuous layer 15 of the "inner" internal wall 12.

Figure 6:
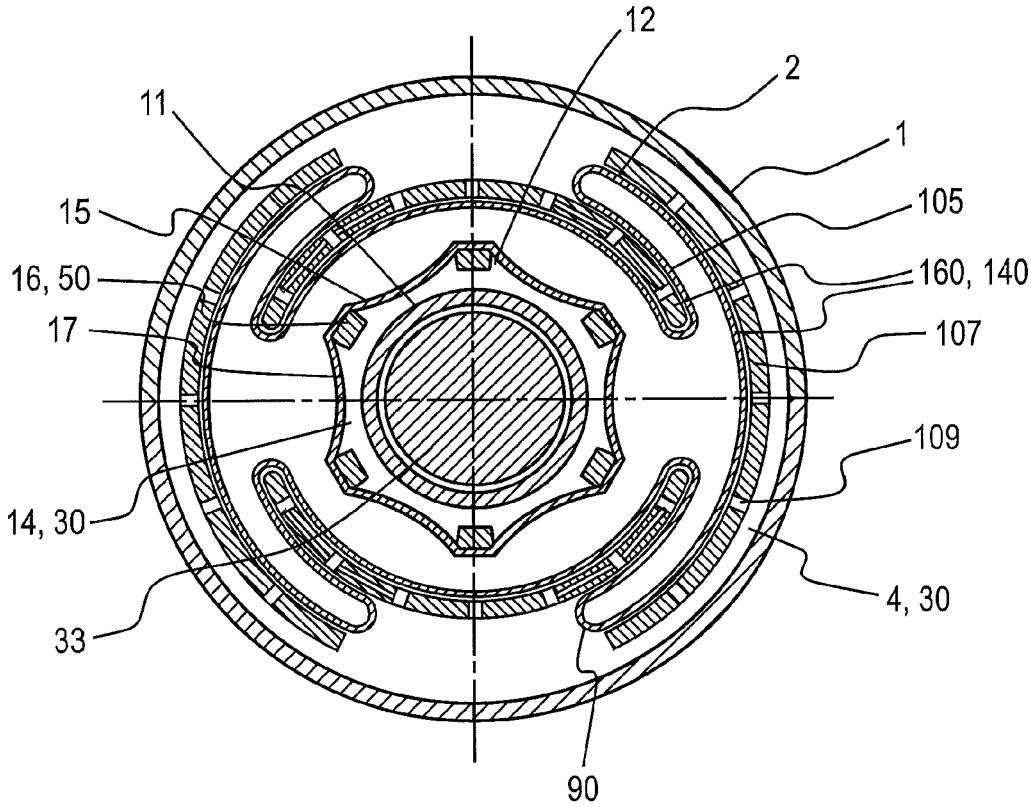
FIG. 6 is a schematic top cross sectional view of a cryostat for electric power conditioner according to the third embodiment.

A further embodiment of a cryostat for power conditioner according to the invention is shown in FIG. 6. Compared to the example of FIG. 5, the inner internal wall 12 is the same and the outer internal wall 2 of the cryostat comprises a further increased circumference (length) of the continuous layer 105. This layer is supported by formers 140 of the discontinuous layer 106.

The formers comprise four segments of the former 140 which can subtend an angle of 150° and which are positioned at two different radii from the axis of the cryostat. This allows a continuous layer 105 with a longer length to be employed and thus the circumferential resistance to be increased. Consequently, eddy currents are suppressed, and cooling and power losses are reduced, especially when the primary coil is provided around the outer side of the cryostat.

The segments of the former 140 comprises a plurality of channels 109 connecting a free space between the continuous layer 105 and the discontinuous layer 106, with the thermal insulating gap 4. The insulation layer 107 is bonded to the respective surfaces of the formers 140. These surfaces of the former 140 also comprise an array of crossing groves which lead to appearance of a relief (which is not shown in FIG. 6) on the surface of the insulation layer 107. This relief represents an extension of a plurality of channels 109 connecting a free space between the continuous layer 105 and the discontinuous layer 106 (namely, the free space between the insulation layer 107 and the continuous layer 105) with the thermal insulating gap 4.

Figure 7:
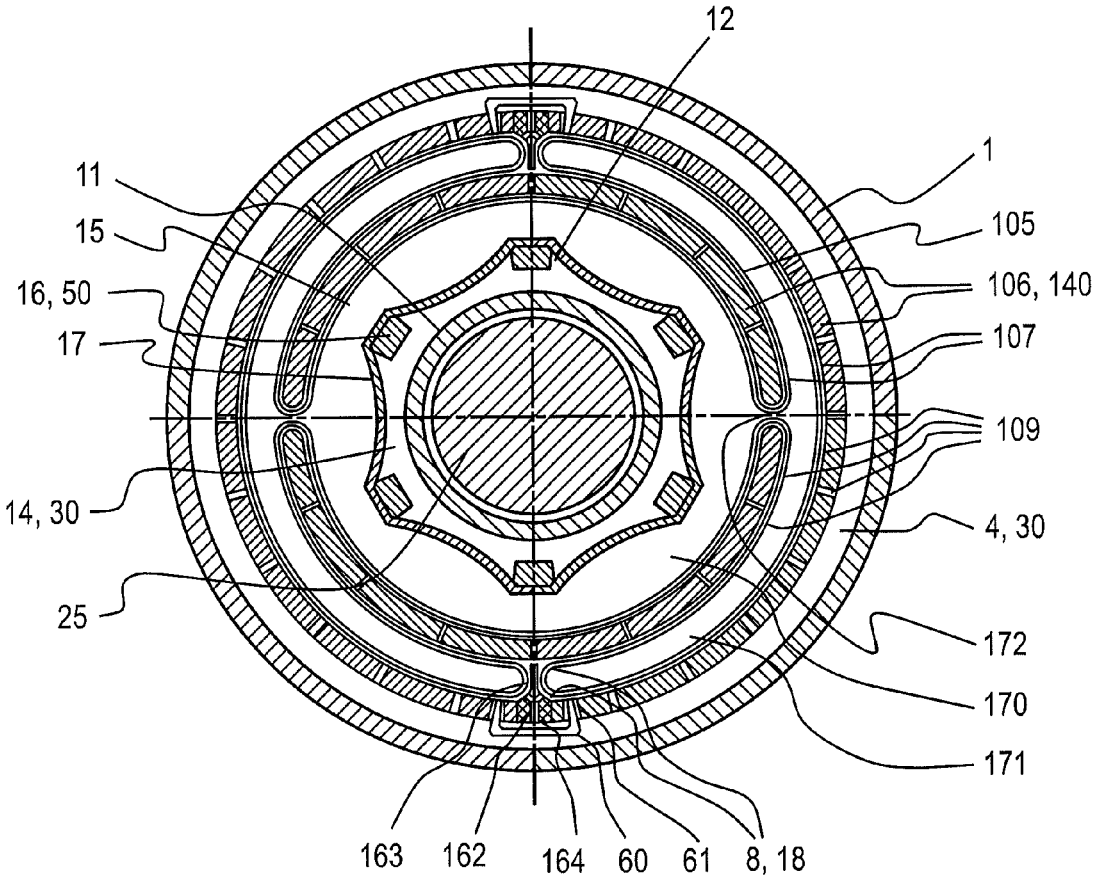
FIG. 7 is a schematic top cross sectional view of a cryostat for electric power conditioner according to a fourth embodiment.

A cryostat with an even more developed circumferential length of the continuous layer is demonstrated in cross-sectional view of FIG. 7. Again the inner internal wall 12 of the cryostat is similar to the embodiments of FIGS. 5 and 6. However, the embodiment of FIG. 7 differs in that the formers 140 of the discontinuous layer 106 of the outer internal wall 12 comprise each subtend an angle of almost 180°. Two channels 172 connect an inner space 170 with an outer space 171. Both of these channels are filled with the cooled medium.

The mechanical stabilizer 141 in this cryostat is provided by the former 140 which comprises an additional electrical insulation 60, 61, 162 that avoids propagation of the circular current which may spread around the at least one axis.

In this embodiment, the additional electrical insulation is provided by four dielectric insertions 61 which insulate two squeezers 60 from the mechanical stabilizers 141. The insert 162 comprises a plurality of channels 164 in an insulating material, which together with the plurality of channels 109 is connecting a free space 8, 18 between the parts of the continuous layer 105 and the discontinuous layer 106 with the thermal insulating gap 4. The insert 162 comprises furthermore an insulating extension 163 that protects against a short circuit that may occur between two neighboring loops of the continuous layer 105. Cryostat of this example allows for additional suppression of cooling losses due to lowering of the Joule heating that dissipates in the internal wall of larger radius.

Figure 8A:
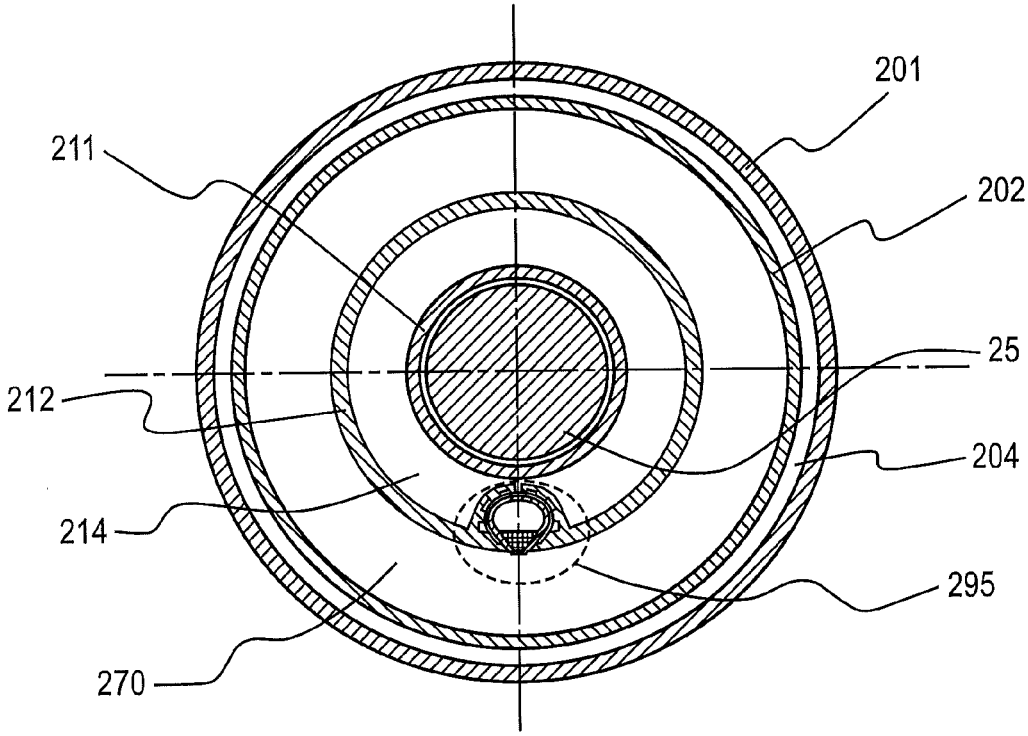
FIG. 8A is a schematic top cross sectional view of a cryostat for electric power conditioner according to a fifth embodiment.

FIG. 8 represents an example of a cryostat for use with a power conditioner comprising only a portion of the layered structure in the internal wall. FIG. 8A shows a schematic cross-section view perpendicular to the cryostat axis. The cryostat comprises the external walls 201, 211, which are in contact with the ambient medium, the internal walls 202, 212, which are in contact with the cooled medium, the thermal insulating gap 204, 214 formed between the external walls and the internal walls, wherein the thermal insulating gap is provided with the thermal insulation. The internal wall 202 comprises a homogeneous structure. A portion 295 of the internal wall 212 comprises a layered structure, while the rest of the internal wall 212 is homogeneous and consists of a single layer.

Figure 8B:
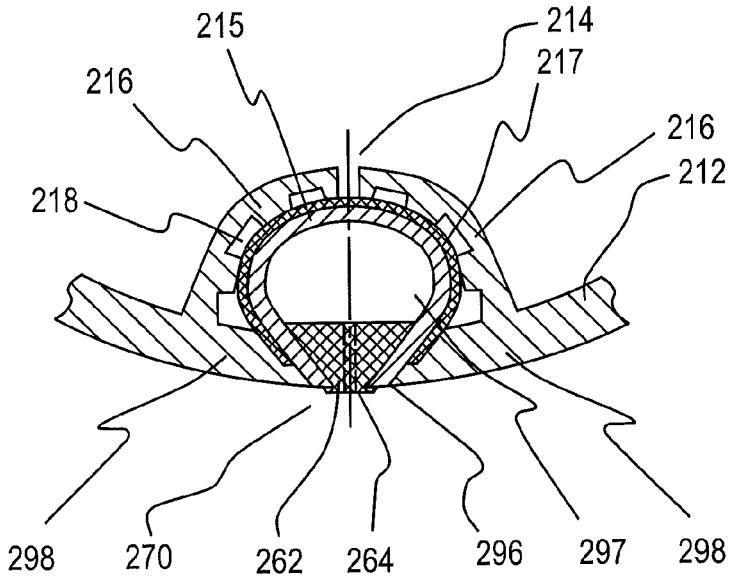
FIG. 8B is a magnified view of a portion of FIG. 8A.

A more detailed view of the portion 295 of the internal wall 212 is depicted in FIG. 8B. The layered structure of this portion comprises the continuous layer 215 and a discontinuous layer 216 that comprises two symmetric parts.

In this example, the continuous layer 215 comprises a metallic stainless steel foil with a thickness of 0.06 mm. The foil is welded to the internal wall 212 from its outer side, i.e. it is welded along the line 296, which is perpendicular to the plane of drawing of FIG. 8. In this area, an extended part 298 of the internal wall 212 provides a portion of the discontinuous layer 216. The insulation layer 217 is placed between the continuous layer 215 and the discontinuous layer 216, 298.

The latter elements function here as a mechanical stabilizer mentioned above. The discontinuous layer 216, 212 (as the mechanical stabilizer) comprises an additional electrical insulation insertion 262 which comprises a dielectric material. A plurality of channels 264 in the insertion 262 connects an inner space 297 with an outer space 270. Both spaces 297, 270 are filled with the cooled medium.

The layered structure further comprises a plurality of channels (not shown in FIG. 8) connecting the free space 218 between the insulation layer 217 and the discontinuous layer 212, 216 with the thermal insulating gap 214. In the embodiment of FIG. 8, the cooling losses are suppressed by a factor of 2 due to suppression of the eddy current in the only one of the internal walls, and due to inserting only a portion of the layered structure.

In the embodiment described above, the layered wall structure was introduced to the internal wall. Obviously the same structure may be well used in the external walls as well. In terms of losses this will lead to further reduction of power loss while the cooling loss is not substantially influenced.

In order to reduce the cooling loss further, the plurality of screens employed in the thermal insulation of the cryostat may comprise some parts/elements of the continuous wall or of the discontinuous wall. For this purpose these walls or their parts are polished and coated with a thin film having a high electrical conductivity, such as, e.g., films of Ag, Au, etc. The film need not be deposited on the entire wall surface but only on to the wall elements which are seen from the side of the thermal insulating gap. This helps to reduce the cooling loss when the width of the thermal insulating gap has to be minimized.

In all embodiments considered above the inner opening may not be present at all as, for example, happens in case of resistive fault current limiters. In such embodiments, the external wall 11, and the internal wall 12 surrounding the external wall 11 as well as the internal wall 12 (see FIG. 1) are not provided.

Furthermore, different walls of the same cryostat may be based on the same continuous layer. In this case each surface of the continuous layer is formed by multiple folding, bending and/or crumpling of a thin metallic foil which is mechanically supported by the discontinuous layer. The neighboring elements of the foil may be protected against electrical contact by the insulation layer bonded to the discontinuous layer. Radii of foil bending satisfy conditions described in the first embodiment example (FIG. 1, FIG. 2).

In further embodiments, the cryostat may include one or more of the following features. The continuous layer may be vacuum tight. This enables the continuous wall to form a part of the thermal insulation of the cryostat which may be provided in the form of a jacket which can be evacuated. The further layers of the layered structure may be positioned in the thermally insulating gap. Alternatively, the further layers of the multilayered wall may be positioned within the working volume and, therefore, be in flow communication with the coolant medium.

The thermal insulation gap may comprise a plurality of screens comprising a high reflectivity in infrared range of optical spectrum. Each screen of the plurality of screens may comprise a structure which does not conduct electrical current in at least one longitudinal direction. The plurality of screens may comprise at least a part of the continuous wall or of the discontinuous wall.

The thermal insulation gap may further comprise a gas absorber or for gas absorbing to help maintain a high vacuum.

The cryostat may comprises a filler for introducing a liquidized gas or/and a gas liquidizer and/or an additional pressure controller for control of pressure of a vaporized gas.

The cryostat according to one or more of the previous embodiments may be used in a fault current limiter or an electrical transformer which may include a superconducting component.

The present invention having been thus illustrated with respect to specific embodiments thereof, it will be understood that these specific embodiments are not intended to limit the scope of the appended claims.

The invention claimed is:

1. A cryostat for electrical power conditioner comprising:

at least one external wall;

at least one internal wall defining a volume to be cooled;

a thermally insulating gap between the at least one external wall and the at least one internal wall, wherein at least one part of the at least one internal wall, and optionally at least one part of the at least one external wall, comprises a layered structure, which layered structure comprises:

a discontinuous layer;

a continuous layer comprising a metal and having a surplus in length in at least one longitudinal direction;

a plurality of channels extending between a free space positioned between the continuous layer and the discontinuous layer and the thermally insulating gap; and the continuous layer has a thickness (t) given by the equation:

$$t=[k*P*R/(2*\sigma)]+g$$

where t (in mm) is the thickness of the continuous layer, k is an experimental coefficient in the range from 0.8 to 2.5, P (in MPa) is a differential pressure between the pressure of an ambient medium acting on the external wall and the pressure of a cooled medium arranged within the internal wall, R (in mm) is a radius of curvature of the continuous layer between two adjacent formers, σ (in MPa) is a maximal tensile stress of the material of the continuous layer, and g=0.002 mm.

2. The cryostat according to claim 1, wherein the surplus in length is in the circumferential direction and in cross section comprises a wavy shape, or a zigzag shape, or a meandering shape, or any combination of these shapes.

3. The cryostat according to claim 1, wherein the continuous layer is flexible.

4. The cryostat according to claim 1, wherein the discontinuous layer comprises at least one segment comprising an electrically insulating material and positioned to hinder the flow of a circular electrical current around said discontinuous layer.

5. The cryostat according to claim 1, where the discontinuous layer comprises a metal.

6. The cryostat according to claim 1, where the discontinuous layer further comprises one or more mechanical stabilizers mechanically coupled to the continuous layer.

7. The cryostat according to claim 6, where the mechanical stabilizers comprise one or more formers which provide at least partial mechanical contact with the continuous layer.

8. The cryostat according to claim 7, wherein the at least partial mechanical contact is provided via an insulation layer.

9. The cryostat according to claim 6, wherein at least one of the one or more mechanical stabilizers comprises electrical insulation arranged to hinder the flow of a circular electric current around said layered structure.

10. The cryostat according to claim 1, where the layered structure of at least one part of the at least one internal wall further comprises an electrical insulation layer arranged between the continuous layer and the discontinuous layer.

11. The cryostat according to claim 10, wherein the electrical insulation layer electrically insulates the continuous layer from the discontinuous layer.

12. The cryostat according to claim 10, wherein the electrical insulation layer electrically insulates different parts of the continuous layer from each other.

13. The cryostat according to claim 10, wherein the electrical insulation layer is bonded to the continuous layer, is bonded to the discontinuous layer, or is bonded to both layers.

14. The cryostat according to claim 1, wherein the maximal thickness of the discontinuous layer exceeds the thickness of the continuous layer by a ratio factor ranging from 2 to 5,000.

15. The cryostat according to claim 14, wherein the ratio factor is 30.

16. The cryostat according to claim 1, wherein the thermally insulating gap comprises a plurality of screens having high reflectivity in the infrared range of the optical spectrum, and which are electrically nonconductive in at least one longitudinal direction.

17. The cryostat according to claim 1, wherein the thermally insulating gap is evacuated, or comprises a gas absorber, or both.

18. An electrical power conditioner comprising a cryostat according to claim 1.

* * * * *